United States Patent [19]

Brugerolle

[11] 4,022,030

[45] May 10, 1977

[54] THERMAL CYCLE FOR THE COMPRESSION OF A FLUID BY THE EXPANSION OF ANOTHER FLUID

[75] Inventor: Jean Renaud Brugerolle, Paris, France

[73] Assignee: L'Air Liquide, Societe Anonyme pour l'Etude et l'Exploitation des Procedes Georges Claude, Paris, France

[22] Filed: Jan. 27, 1972

[21] Appl. No.: 221,294

[30] Foreign Application Priority Data

Feb. 1, 1971 France ..... 71.03262

[52] U.S. Cl. ..... 62/30; 62/32

[51] Int. Cl.[2] ..... F25J 3/02

[58] Field of Search ..... 62/17, 20, 23, 24, 27–30, 62/26, 41, 40, 32

[56] References Cited

UNITED STATES PATENTS

| | | | |
|---|---|---|---|
| 2,666,019 | 1/1954 | Winn | 62/23 |
| 2,708,490 | 5/1955 | Guinot | 62/17 |
| 2,880,591 | 4/1959 | Kwauk | 62/17 |
| 2,918,802 | 12/1959 | Grunberg | 62/41 |
| 2,970,451 | 2/1961 | Ehrlich | 62/23 |
| 2,982,107 | 5/1961 | Smith | 62/22 |
| 3,212,276 | 10/1965 | Eld | 62/40 |

FOREIGN PATENTS OR APPLICATIONS

| | | | |
|---|---|---|---|
| 54,345 | 2/1968 | Poland | 62/17 |

*Primary Examiner*—Hiram H. Bernstein
*Attorney, Agent, or Firm*—Young & Thompson

[57] ABSTRACT

A method of and an installation for utilizing a thermal cycle by means of which a less volatile fluid can be compressed by the expansion of a more volatile fluid, is characterized in that, in the course of said cycle a less volatile fluid available in a fractionated separation zone working under a low pressure is put into liquid-vapour equilibrium in counter-flow in said separation zone at said low pressure, with one or more light fractions at most as volatile as said more volatile fluid, so as to obtain, under said low pressure, the more volatile fluid and one or more heavy fractions at least as volatile as said less volatile fluid, and in that, after compression of said heavy fraction from said low pressure to a high pressure, the more volatile fluid available in a fractionated mixture zone working under said high pressure is put into liquid-vapour equilibrium in counter-flow in said mixture zone under said high pressure with one or more heavy fractions so as to obtain said less volatile fluid at said high pressure. The invention is applicable to various technical fields including the distillation of mixtures of several constituents and provides a means of recovery in the form of mechanical energy, refrigeration and the like, of a substantial portion of the excess energy consumed in the primary process.

26 Claims, 12 Drawing Figures

THERMAL CYCLE FOR THE COMPRESSION OF A FLUID BY THE EXPANSION OF ANOTHER FLUID

The present invention relates to any method comprising at least one thermal cycle which makes it possible to compress a less volatile fluid by the expansion of a more volatile fluid. It also relates to any installation comprising a thermal system which enables the said thermal cycle to be carried into effect.

The invention is applicable to various technical fields, amongst which there may be cited the distillation of a mixture of several constituents, in particular that of air, the production of mechanical energy, refrigeration, etc.

Numerous industrial, physical or chemical methods permitting the delivery of energy (in the mechanical, thermal form, etc.) or the manufacture of a product, consume, even with an optimum overall efficiency, an amount of energy which is considerably greater than that theoretically necessary for delivering the said energy or manufacturing the said product. When it is impossible for various reasons to replace the method employed by another with higher performance, and when the energy consumed represents a substantial part of the cost of the energy delivered or the product manufactured, it is essential to recover, in one form or another, at least part of the excess energy consumed, by any appropriate means.

For this purpose, it is for example possible to expand a gas available under high pressure, in an expansion turbine, in order to recover in a mechanical form at least a part of the energy consumed in order to compress another gas or an identical gas in a compressor.

The present methods of production of oxygen, by fractionated distillation of air provide an illustration for these considerations. These methods generally utilize a double column of rectification in which the air is separated into oxygen and nitrogen. Under present economic conditions, the energy consumed in compressing the air to be distilled represents nearly one-half of the price of the oxygen produced. If it is considered that the efficiencies of the various steps of these methods (heat exchanges, expansions of liquids and gases, etc.) have their optimum value, the power consumed nevertheless remains very much greater than the theoretical power necessary to separate oxygen from air.

In fact, the medium pressure of the lower column only depends on the relative boiling points of oxygen and nitrogen. In consequence, the power expended is independent of the composition of the supply of the double column. In the case of air, its composition (21% of oxygen) does not correspond to the limit of the possibilities of the cycle with two columns.

An excessive amount of power is thus consumed. Up to the present time, the only method of recovery of this excess power is in the form of frigorific energy available so as to obtain one part of the product or products in the liquid state. In certain cases, it is advantageous to be able to recover at least part of this excess power in the form of compression energy, and thus to be able to recompress one of the products of distillation of air.

The present invention has therefore for its object a thermal cycle which makes it possible, in any method, to recover, in the form of a compression energy, at least part of an excess of power consumed by the said method, and especially of an excess of energy consumed in a method of separation by distillation.

In a thermal cycle according to the invention, in order to compress a less volatile fluid by expansion of a more volatile fluid, there is put into liquid-vapour equilibrium, in counter-flow in a zone of fractional separation working under at least one low pressure, at least the less volatile fluid available in the said separation zone under a said low pressure, with at least a light fraction at most as volatile as the more volatile fluid, in order to obtain, under a said low pressure, the more volatile fluid and at least one heavy fraction at least as volatile as the less volatile fluid; after compression of at least one said heavy fraction from a said low pressure to at least a high pressure, there is put into liquid-vapour equilibrium in counter-flow in a zone of fractional mixture working under at least one said high pressure, at least the more volatile fluid available in the said mixture zone under a said high pressure, with at least one said heavy fraction, in order to obtain, under one said high pressure, at least the less volatile fluid.

The said less volatile and more volatile fluids, the said heavy fraction and the said light fraction may each be a pure substance or a mixture of pure substances.

By fractional separation zone there is meant an assembly comprising one or a number of fractionated separation columns working under a low pressure. In the case of a number of separation columns, these may work under low pressures which are identical or different, they may be connected or thermally associated with each other, for example by means of a vaporizer-condenser.

By fractionated mixture zone, there is understood an assembly comprising one or a number of fractionated mixture columns working under high pressure. In the case of a number of mixture columns, these may work under identical or different high pressures, they may be connected or thermally associated with each other, for example by means of a vaporizer-condenser.

By liquid-vapour equilibrium in counter-flow there is meant an exchange of material and heat between a liquid phase and a vapour phase circulating in counter-flow, such as takes place in a rectification or washing column.

By mixing column there is therefore understood a column comprising means for establishing a liquid-vapour equilibrium, such as trays, packings, etc., defining a certain number of theoretical trays, in which the heavy products are introduced at the top and the light products at the bottom of the said column, and in which a mixture of the said products is extracted, if so desired, at an intermediate zone of the said column.

A thermal cycle according to the invention thus permits in any method, by choosing and expanding a more volatile appropriate fluid available in the said method at a high pressure, the compression of an appropriate less volatile fluid available at a low pressure, and thus recovering from at least one part of the energy consumed to an excessive extent, in the form of a compression of the less volatile fluid.

In the case of a fractionated distillation process permitting the separation of a heavy constituent and a light constituent from a mixture, the thermal cycle according to the invention makes it possible to recover at least part of the energy dissipated, in the form of a compression of a less volatile fluid, by choosing to expand a more volatile fluid available in the process utilized.

In the case where the distillation process utilized employs a distillation zone working under at least one low pressure, it is particularly advantageous to utilize the fractionated separation means available in the distillation zone to effect, in the thermal cycle according to the invention, the liquid-vapour equilibrium in counter-flow of at least the less volatile fluid with at least one light fraction in the said distillation zone. It is therefore advantageous to integrate the fractional separation zone of the thermal cycle utilized in the fractionated distillation zone of the distillation process.

The application of a thermal cycle according to the invention to a process of distillation makes it possible to illustrate a further advantage conferred by the invention, resulting from the compression of the less volatile fluid or from the expansion of the more volatile fluid. While the invention permits the recovery of at least part of the power consumed in any process, it can further be said that, in certain cases, it finally permits the revalorization of frigories or of calories and therefore permits the recovery of these latter in order to produce supplementary calorific or frigorific energy which compensates for at least part of the energy consumed by the said process. Finally, in these cases, the thermal cycle according to the invention permits the recovery of at least part of the energy consumed in the frigorific or calorific form.

In fact, if any less volatile fluid available in the distillation process employed is re-compressed from a low pressure to a high pressure, this means that its heat previously available at a low level of temperature (by condensation for example) is now available at a high temperature level. In certain cases, it thus becomes possible to exchange this revalorized heat with any other fluid of the process employed, and therefore to recover in the calorific form at least of the energy consumed so as to effect the distillation, and in consequence to improve the efficiency of this latter.

Similarly, if any more volatile fluid available in the process of the distillation employed is expanded from a high pressure to a low pressure, this means that its cold previously available at a high level of temperature (by vaporization for example) is now available at a low level of temperature. It then becomes possible in certain cases to exchange this cold thus revalorized with any other fluid of the process employed, and therefore to recover in the frigorific form at least part of the energy consumed in effecting the distillation.

In the case of a process of fractionated distillation of air, permitting the separation of oxygen and at least nitrogen, the thermal cycle according to the invention permits in the same manner the recovery of at least a part of any excess energy consumed in separating the air into at least one of its constituents, by compressing a less volatile fluid available in the said process, by expansion of another and more volatile fluid.

When the distillation zone utilized comprises at least one distillation column under a low pressure and one other distillation column under a mean pressure higher than the low pressure, associated thermally through the intermediary of a vaporizer-condenser, it is especially advantageous to use the liquid vapour equilibrium means of the column under low pressure by integrating the fractionated separation zone of the thermal cycle in the column under low pressure.

While the thermal cycle according to the invention makes it possible in the case of a distillation process to recover at least part of the energy consumed, especially in the thermal form, the said cycle permits however, in the general case, the simultaneous compression of a fluid and the expansion of another fluid. In this sense, the thermal system permitting the utilization of a thermal cycle according to the invention is similar to a group comprising a compressor and an expansion turbine working on the same shaft. The originality of a thermal system according to the invention resides in the fact that the compression and the expansion are effected without any other mechanical devices apart from one or more pumps for compressing a liquid.

It has proved that a thermal cycle according to the invention may be advantageously employed in other technical fields than that previously referred to. Amongst these applications, there may be cited the production of mechanical energy (work-generating cycles), and refrigeration (frigorific cycles).

If, during a thermal cycle according to the invention the less volatile fluid compressed under a high pressure is expanded in any appropriate means enabling mechanical work to be carried out, especially in an expansion turbine, a thermal cycle according to the invention is thus transformed into a work-generating cycle delivering mechanical energy. In this case, it is only necessary to re-cycle the less volatile fluid, expanded from a high pressure to a low pressure, with the production of mechanical energy in the zone of fractional separation and to re-cycle the more volatile fluid re-compressed from a low pressure to a high pressure, into the fractionated mixture zone.

In these applications to work-generating cycles, a thermal cycle according to the invention can be particularly well integrated in a steam cycle comprising an auxiliary ammonia cycle, these two constituents then forming respectively the less volatile and the more volatile fluids.

If, during a thermal cycle according to the invention, the less volatile fluid compressed under high pressure is condensed by any appropriate means (in particular by an external refrigerant such as water) and if the less volatile condensed fluid is expanded and vaporized under low pressure in order to produce cold, there is thus obtained a thermal cycle according to the invention in one stage of refrigeration, in which the refrigerant is the less volatile fluid itself.

In this case, it is only necessary to re-compress the refrigerant or less volatile fluid which has been vaporized, by expansion of a more volatile fluid than the said refrigerant, and therefore to re-cycle the vaporized refrigerant into the separation zone of the thermal cycle.

The invention also relates to any installation incorporating a system which enables a thermal cycle according to the invention to be utilized. Such a thermal system according to the invention comprises a fractionated separation zone working under at least a low pressure, and a fractionated mixture zone working under at least one high pressure, the two said zones comprising liquid-vapour equilibrium producing means in counter-flow, especially trays, at least one conduit connecting the separation zone to the mixture zone, on which is disposed a compression means, at least one further conduit connecting the mixture zone to the separation zone, on which is disposed an expansion means.

The present invention will now be described in its general aspect and in its particular methods of embodiment, depending on the technical fields in which it is applied, by reference to the accompanying drawings.

It should be stated that in all the figures, identical or similar parts are identified by the same reference numbers. In the accompanying drawings.

Figure 1:
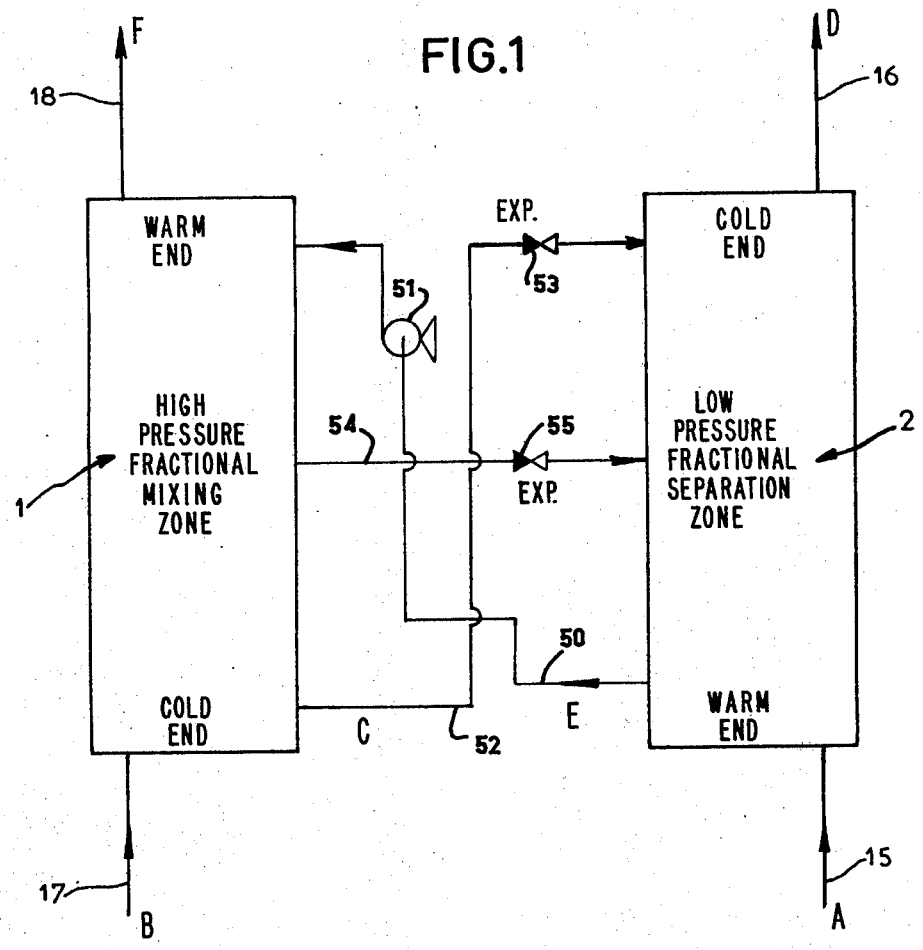
FIG. 1 represents the basic thermal system permitting the utilization of a thermal cycle according to the invention in order to compress a fluid by the expansion of another fluid.

Referring now to FIG. 1, a thermal system according to the invention, permitting the compression of a less volatile fluid by the expansion of a more volatile fluid comprises essentially a fractionated mixture zone 1 having a single column for fractionated mixture working under a high pressure and a fractionated separation zone comprising a single fractionated separation column working under a low pressure.

The mixture column and the separation column comprise means permitting the production of a liquid-vapour equilibrium, a liquid and a gas circulating in counter-flow in these columns; they are in general trays or any appropriate packing. A conduit 50 on which is arranged a compression means or pump 51, connects the lower portion of the separation column 2.

To the upper portion of the mixing column 1. A first other conduit 52 on which is disposed an expansion means or expansion valve 53, connects the lower portion of the mixing column 1, to the upper portion of the separation column 2. A second other conduit 54, on which is arranged an expansion means or expansion valve 55, connects a central portion of the mixing column, to a central portion of the separation column.

In operation, the thermal cycle according to the invention permits the compression of a less volatile fluid by the expansion of a more volatile fluid. To that end, at least the less volatile fluid, coming in at a low pressure in the gaseous state through the conduit 15 into the tank of the fractionated separation column 2, is put into liquid-vapour equilibrium in counter-flow in the said column at low pressure with at least a first light fraction having a volatility less than that of the more volatile fluid which arrives in the liquid state through the conduit 52 at low pressure into the head of the separation column 2, and with at least one second light fraction having a volatility comprised between that of the less volatile and more volatile fluids, coming in the liquid state through the conduit 54 at low pressure into an intermediate zone of the separation column 2.

There is thus obtained at low pressure in the tank of the column 2, at least one heavy fraction having a volatility higher than that of the less volatile fluid evacuated through the conduit 50 in the liquid form, and at the head of the column 2, at least the more volatile fluid at low pressure, evacuated in the gaseous state through the conduit 16.

The heavy fraction evacuated by the conduit 50 is then compressed from the low pressure to the high pressure in the pump 51, and is then introduced, still in the liquid state, into the head of the fractionated mixture column. It is then put into liquid-vapour equilibrium in counterflow, in the mixture column 1 at high pressure with at least the less volatile fluid arriving in the gaseous state at high pressure into the tank of the mixture column 1 through the conduit 17.

There is thus obtained at the head of the mixture column 1 at least the less volatile fluid in the gaseous state evacuated under high pressure through the conduit 18. There is also obtained, in the tank and at an intermediate zone of the mixing column 1, in the liquid state and at high pressure, respectively the first light fraction evacuated by the conduit 52 and the second light fraction evacuated by the conduit 54.

After expansion from the high pressure to the low pressure respectively in the valves 53 and 55, the first and second light fractions are re-introduced into the fractionated separation column 2 at low pressure and are put into liquid-vapour equilibrium in counter-flow in the said column with at least the more volatile fluid. By virtue of the thermal cycle according to the invention, the more volatile fluid and the less volatile fluid have thus exchanged their pressures.

By way of example, it is possible with a thermal cycle in accordance with FIG. 1, to compress gaseous propylene by the expansion of gaseous ethylene.

The supply and extraction of fluid from the mixing column 1 and the separation column 2 can of course be effected, indifferently in the liquid, gaseous and two-phase forms.

This has only effect on the quantities of heat and cold injected into the fractionated separation zone 2 and into the fractionated mixture zone 1.

All the method utilized in calculating and designing a distillation column, in particular the number of theoretical trays necessary for the said distillation, may be utilized in order to determine in particular the number of theoretical trays necessary for the liquid-vapour equilibrium, effected respectively in the fractionated mixture column 1 and in the fractionated separation column 2. This is also valid for the method of McCabe and Thiele which permits in the case of a distillation an evaluation of the number of theoretical trays required, depending on the purity of the products introduced and evacuated from a distillation column.

As shown by the demonstration given below, made with reference to FIGS. 2 to 6, the method of McCabe and Thiele makes it possible in the case of a thermal cycle according to the invention to evaluate easily and graphically the number of trays necessary for the fractionated separation carried out in the column 2, and the number of trays necessary for the fractionated mixture effected in the column 1.

If the same calculation assumptions are adopted as those of the method of McCabe and Thiele, especially the following:

The heat of vaporization of the pure substances utilized in the mixing column 1 and in the separation column 2 are substantially equal;

The specific heats of the said substances are substantially the same; it is possible to apply the same reasoning at the level of a theoretical tray of order $p$ of a separation column or mixture column according to the invention, as that used at the level of a theoretical tray of a distillation column according to the method of McCabe and Thiele.

If there are respectively designated by A and B a more volatile pure constituent and a less volatile pure constituent to which the more volatile fluid and the less volatile fluid can be respectively compared (apart from their purities), and if there are designated by $x$ and $y$ the contents of more volatile constituent A (expressed in mols %), respectively of a liquid phase and a gaseous phase in equilibrium on a single theoretical tray, it can be said in the case of a tray of order $p$ of a separation column 1 (see FIG. 2) that by sending to the said tray a liquid flow of a fluid I having a content $xp + I$ and a gaseous flow of a fluid J having a content $xp - I$, there is removed from the tray of order $p$ a liquid flow L having a content $xp$, equal to the liquid flow of the fluid I, and a gaseous flow G having a content $yp$ equal to the gaseous flow of the fluid J, the liquid L and the gas G being constituted by mixtures of the concomitant constituents A and B.

If the direction of arrival of the fluids I and J are reversed (see FIG. 3), the fluid I now arriving in the gaseous form and the fluid J arriving in the liquid form, there is obtained a theoretical tray or order $p$ of a mixing column 1 of a thermal cycle according to the invention.

In this case, the liquid L and the gas G leaving the tray of order $p$ have contents of the more volatile constituent A and the less volatile constituent B which are absolutely identical with those of the liquid L and the gas G, leaving the tray of order $p$ shown in FIG. 1.

Figure 2:
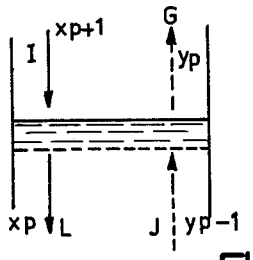
FIGS. 2 and 3 show diagrammatically a theoretical tray of the order *p* of a fractionated separation column and a fractionated mixture column respectively, of a thermal cycle according to the invention.
Figure 3:
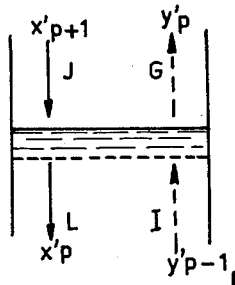

In fact, the material balances of the trays of order $p$ shown respectively in FIGS. 2 and 3 remain the same.

Applying the reasoning step-by-step to all the trays, for a tray or order $p$ there is determined in the first case (see FIG. 4) the fractionated separation column shown in FIG. 1 and in the second case (see FIG. 5) the fractionated mixture column 1. The mixture column 1 and separation column 2 thus operate in the reverse manner.

If it is considered as for the method of McCabe and Thiele that the liquid flow L and the gaseous flow G circulating in counter-flow one with respect to the other, are invariable along the mixture column 1 and along the separation column 2 respectively, it can easily be shown that:

1. In the case of the fractionated separation column 2, the co-ordinate points $(xn + I, yn)$, $(xn, yn - I)$, etc. are aligned on the same straight reflux line having a slope L/G; the points of co-ordinates $(yo, x_1)$; $(y, x_2)$ etc., are aligned on the same straight drainage line having a slope L'/G'; these two straight lines are located in the interior of the curve of equilibrium at low pressure (see FIG. 6);

2. In the case of the fractionated mixture column 1, the points of co-ordinates $(y'n, x'n + 1)$, $(y'n - 1, x'n)$ etc. are aligned on the same straight drainage line having a slope L'/G'; the points of co-ordinates $(y'o, x'1)$, $(y', x')$ are aligned on the same straight reflux line having a slope $L'/G'$.

Figure 6:
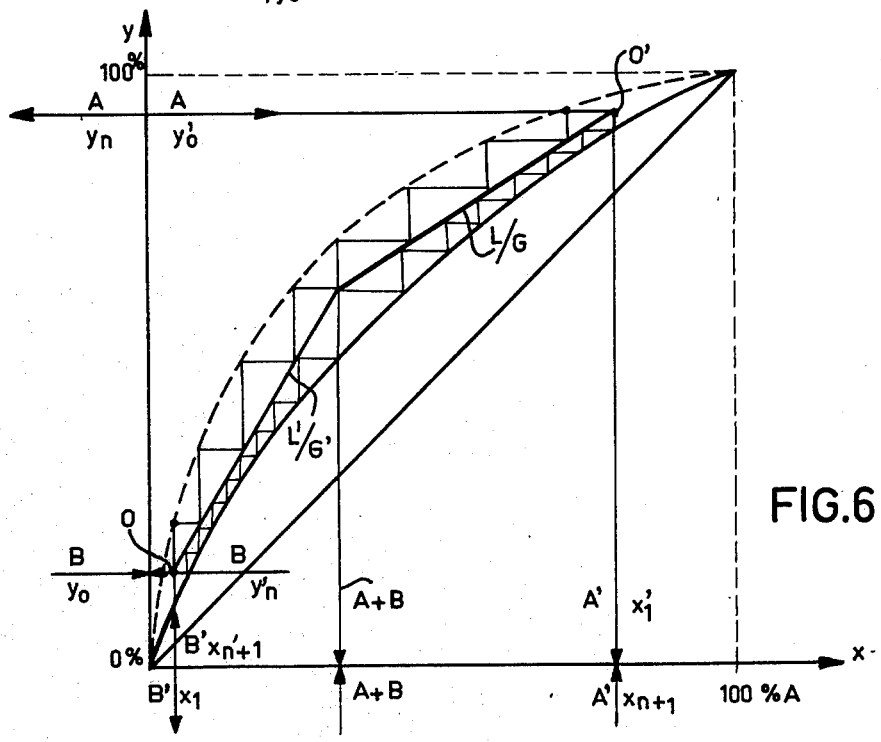
FIG. 6 shows graphically with reference to FIGS. 4 and 5 in a manner similar to the method of McCabe and Thiele, the liquid-vapour equilibrium effected in the separation column and in the mixture column of a cycle according to the invention.

These two straight lines are located at the exterior of the curve of equilibrium at high pressure (see FIG. 6).

By reason of the above demonstration, the straight reflux lines of the mixture column and the separation colummn are identical. This is also true for the straight drainage lines. These two straight lines are located in the interior of the group constituted by the curves at high pressure and low pressure. (refer to FIG. 6)

Figure 4:
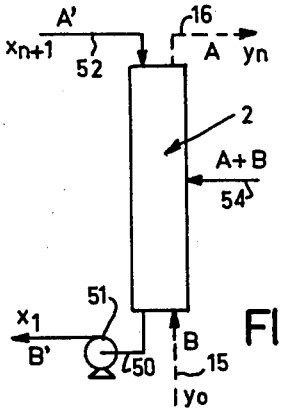
FIGS. 4 and 5 show diagrammatically the said separation column and the said mixture column, using the same symbols as adopted in FIGS. 2 and 3.
Figure 5:
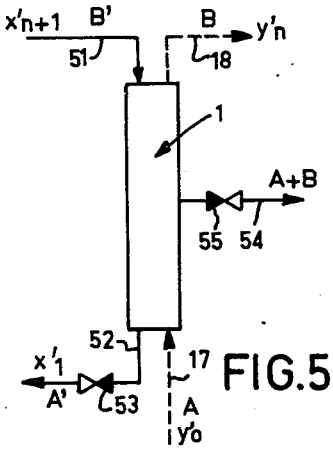

From this point, as in the method of McCabe and Thiele, it is possible to illustrate graphically (as in FIG. 6, by reference to FIGS. 4 and 5, the liquid-vapour equilibrium effected respectively in the mixing column 1 and in the separation column 2.

In this figure, the curves of liquid-vapour equilibrium of the constituents A and B are shown in full lines for the high pressure (column 1) and in broken lines for the low pressure (column 2). It is thus found that the straight lines of reflux L/G and drainage L'/G' are located between the two equilibrium curves and that the number of steps less 1 located between the broken line curve and the straight lines of reflux and drainage, and between the curve in full lines and these same straight lines, determines the number of trays necessary respectively for the fractionated separation and the fractionated mixture.

A study of FIG. 6 will make it easy to understand the advantage of an extraction from an intermediate zone of the mixture column 1 and a corresponding introduction into an intermediate zone of the separation column 2.

If this extraction did not exist, the straight lines of reflux and drainage for the two columns would be coincident along a segment of a straight line comprised between the two curves of equilibrium, the extremities of which cannot be identical with the points O and O'. In consequence, by introducing the less volatile fluid at low pressure into the column 2 and the more volatile fluid under high pressure into column 1, it is impossible again to find the less volatile fluid under high pressure and the more volatile fluid under low pressure, with their initial purities. Only an intermediate extraction can therefore bend the reflux-drainage straight line and again find the initial purities of the less volatile and more volatile fluids.

Similarly, FIG. 6 makes it possible to understand the advantage obtained by the fact that the mixing column is at a pressure higher than that of the separation column.

In the contrary case, the reflux-drainage straight lines of the mixing column 1 and the separation column 2 would be arranged on each side of the zone included between the two equilibrium curves at low pressure and high pressure. It is then impossible, as previously, to find again the more volatile fluid at low pressure with the purity which it had under the high pressure. Similarly, it is impossible to find again the less volatile fluid at the high pressure, with the same purity that it had under low pressure.

Only the thermal cycle according to the invention makes it possible to work with straight lines of reflux-drainage which can be coincident and therefore make it possible again to find the initial purities of the less volatile and more volatile fluids.

Figure 7:
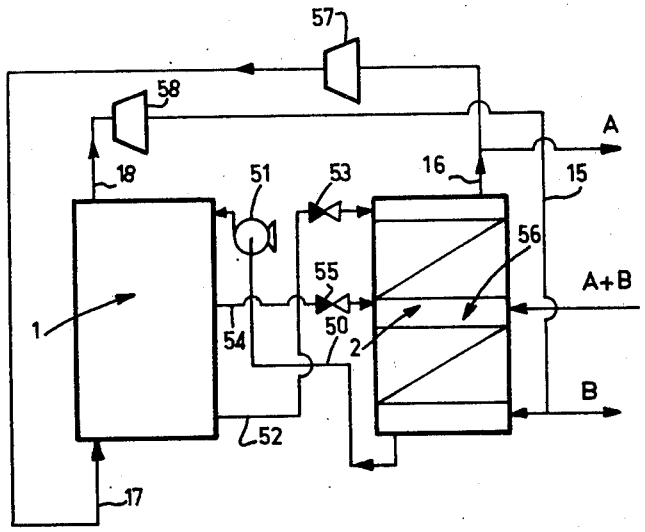
FIG. 7 represents a distillation installation permitting the separation of a heavy constituent from a light constituent of a mixture. This installation comprises a thermal system according to the invention.

FIG. 7 represents a fractionated distillation installation for a mixture comprising a light constituent A and a heavy constituent B, comprising a thermal system according to the invention. This installation comprises a distillation zone 56 comprising a single distillation column working at low pressure. The fractionated separation zone 2 of the thermal system according to the invention is incorporated in the distillation zone 56 of the installation.

In operation, there is thus effected a fractionated distillation of a mixture of A and B in the column 56 under a low pressure in order to separate out the constituent B in the tank and the constituent A at the head. In order to recover at least part of the thermal energy dissipated in separating the mixture A and B, a thermal cycle according to the invention is employed. For that purpose, there are chosen as the less volatile and more volatile fluids, two fluids which are available in the separation zone 56.

These are respectively a fraction at least as volatile as the heavy constituent B, if so desired constituted by a part of this latter, and a fraction at most as volatile as the light constituent A, constituted if so desired by a part of this latter.

As in the case of FIG. 1, the liquid-vapour equilibrium in counter-flow of the less volatile fluid coming in through the conduit 15 at low pressure, with at least one light fraction arriving through the conduit 52 at this same pressure, is effected in the distillation zone 56 which incorporates the separation zone 2.

The liquid-vapour equilibrium in counter-flow of the more volatile fluid chosen coming in through the conduit 17 at a high pressure higher than the low pressure is also effected as in FIG. 1 in the fractionated mixture zone, separate from the distillation zone 56, with at least one heavy fraction arriving through the conduit 51 at the said high pressure.

Thus, by choosing to expand to the low pressure a more volatile fluid extracted from the column 56 under low pressure through the conduit 16 and then compressed to the high pressure in a compressor 57, it is possible to compress to the high pressure a less volatile fluid introduced into the column 56 at low pressure through the conduit 15. This compression energy is recovered in the form of mechanical work in a expansion turbine 58, and the less volatile fluid, after this expansion from the high pressure to the low pressure, is re-cycled into the distillation zone 56 through the conduit 15.

Finally, if it is assumed for example that the constituent A is not wholly valorizable, it is thus possible to recover in the form of mechanical work in the expansion turbine 58 by the use of a thermal cycle according to the invention, an excess of mechanical energy representing at least part of the thermal energy expended in separating the constituent A from the mixture constituted by A + B. This excess represents at least part of the mixture energy liberated in the fractionated mixture zone 1 by the fractionated mixture of the heavy fraction arriving through the conduit 50 (which may possibly be the pure substance B) and of the more volatile fluid (which may be the pure fluid A) arriving through the conduit 17. In this specification, the mixture column 1 makes it possible to re-mix two fluids separated in the distillation column 56 in a much more reversible manner than a simple direct mixture of these two fluids. It is thus possible to recover in the mechanical form the maximum amount of energy liberated by the mixture of the heavy fraction and the more volatile fluid.

Figure 8:
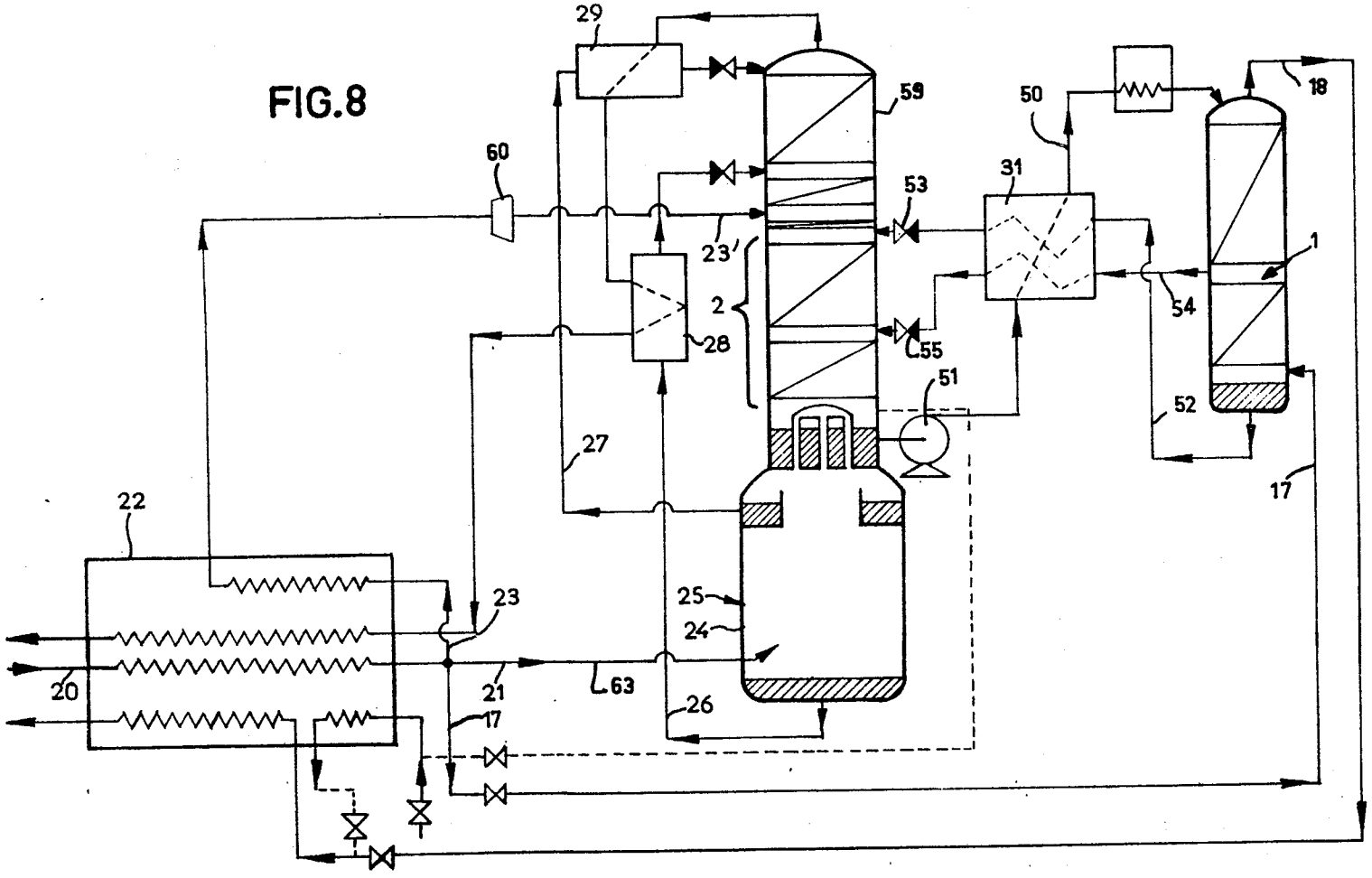
FIG. 8 represents an installation for the separation of air into oxygen and nitrogen, incorporating a thermal system according to the invention, which enables oxygen to be produced under pressure.

FIG. 8 represents the application of FIG. 7 to the case of separation of air into oxygen and nitrogen.

It is known that in all the presently existing large units for separation of air, the energy consumed represents an important part of the cost of production of the oxygen.

This energy is essentially consumed by the compression of the air to be distilled. Now, in apparatus in which the distillation zone comprises a column under low pressure and a column under medium pressure, thermally associated (which are practically the only ones employed in the production of oxygen on a large scale), there is encountered a physical limit below which the pressure of air introduced into the column at medium pressure cannot be reduced.

In practice, this pressure is located at about 6 bars absolute. Part of the air thus compressed to 6 bars is expanded in a turbine working at low temperature in order to ensure the behaviour under cold of the installation. The expanded air is then sent into a zone of the column at low pressure and the oxygen which it contained is further extracted from it, practically wholly, on condition however that the flow-rate of air thus blown directly into the column at low pressure does not exceed 10 to 15% of the total flow of air sent into the distillation zone, if it is desired to produce oxygen at 99.5% purity, and 25% to 35% if it is desired to produce oxygen at a purity of 97% only.

Now, except in special cases in which it is desired that the installation for air separation also produces oxygen in the liquid form, the behaviour under cold oflarge installations is widely ensured by a flow of air passing into the turbine, of the order of 7% of the total flow-rate. If oxygen is produced at 97% purity and if there is blown into the column at low pressure more than 7% of the total flow-rate of air but less than 25% to 30% of the said flow-rate, there is thus consumed an excess amount of energy with respect to that necessary for extracting oxygen from the air treated. The installation possesses excessive separation power.

In this case, a thermal cycle according to the invention makes it possible to recover, at least a part of the excess energy consumed.

To this end, according to FIG. 8, the installation shown for carrying out a fractionated distillation of air, in which the fractionated distillation zone 25 comprises a column 59 at a low pressure (1.3 ata) and a column 24 at a medium pressure (6 ata) further comprises a thermal system according to the invention in which the fractionated separation zone or mixture column 1 is separate from the distillation zone 25, and in which the fractionated mixture zone is incorporated in the column 59 at low pressure, along a fractionated separation section 2 extending over at least part of this latter, the lower part of which is located in the tank of the said column 59 at low pressure, and in which the upper part is located in an intermediate zone of the said column.

In operation, 1000 $Nm^3$/hr of air at 30° C. and 6 ata are brought in by the conduit 20 to the installation of FIG. 8. After cooling in the exchanger 22 to a temperature of −172° C., 68% of this air is led through the conduit 21 towards the column 24 under medium pressure, of the distillation zone 25. From the tank of this column there are extracted through the conduit 26, 340 $Nm^3$/hr of a liquid enriched in oxygen at −172° C., and at the head, through the conduit 27, about 340 $Nm^3$/hr of nitrogen at 177° C. The two conduits 26 and 27 then respectively pass into the exchangers 28 and 29 in counter-flow with a flow of gaseous nitrogen at 1.3 ata and −193° C. produced at the head of the column 59 at low pressure in the distillation zone 25.

The flow of gaseous nitrogen (790 $Nm^3$/hr at 1.5% impurity) leaves the exchanger 29 at −179° C. and then the exchanger 28 at −175° C. and becomes heated in counter-flow with the entering air in the exchanger 22 which it leaves at +27° C. The flow enriched in oxygen in the conduit 26 is introduced, after expansion to 1.3 ata at a temperature of −177° C. in the column 59 at low pressure.

Similarly, the flow of nitrogen in the conduit 27, after expansion to 1.3 ata, is introduced at a temperature of −191° C. into the column 59 at low pressure. About 8% of the air introduced at 6 ata is again heated, at least partially, in the exchanger 22 and leaves this latter at −158° C. and then, after expansion to 1.3 ata in the expansion turbine 60, this air is blown into the column 59 at low pressure, through the conduit 23'.

According to FIG. 8; at least part of the excess energy consumed in distilling air to oxygen and nitrogen, is recovered in the form of compression energy by choosing the oxygen obtained in the tank of the column 59 at low pressure as the less volatile fluid and choosing air at the medium pressure as the more volatile fluid. By expansion of the air from the medium pressure to the low pressure, it is thus possible to re-compress the oxygen from the low pressure to the medium pressure and to dispose of this under pressure.

For that purpose, in order to obtain the less volatile fluid necessary for the thermal cycle according to the invention, at least part of the liquid oxygen obtained in the tank of the column 59 at low pressure is vaporized. The oxygen vaporized in then put into liquid-vapour equilibrium in counter-flow in the fractionated separation zone 2 at low pressure with a light fraction introduced into the head of the separation section 2 through the conduit 52, and another light fraction introduced into an intermediate point of the said section 2 through the conduit 54.

There is thus obtained a less volatile fluid having a composition close to that of air, at the head of the section 2. This fluid is then distilled in the upper section of column 59 located above the fractionated separation section 2. In the tank of the section 2 there is thus obtained a heavy fraction constituted by the oxygen collected in the tank of column 59, with a purity equal to 98%, extracted from the said column at the rate of 400 $Nm^3$/hr.

The heavy fraction extracted through the conduit 50 is then compressed in the pump 51 from the low pressure to the medium pressure, and is then heated before its introduction into the mixing column 1, from −180° C. to −172° C. by exchange of heat in the exchanger 31 with the light fraction circulating in the conduit 52, in course of cooling from −172° C. and with the other light fraction circulating in the conduit 54, in course of cooling from −167 C. to −178° C. After an additional heating, the heavy fraction is introduced at −162° C. into the head of the mixing column 1, working at the medium pressure of 5.8 ata.

There are simultaneously introduced through the conduit 17 at −172° C. and 6 ata into the tank of the column 1, about 240 $Nm^3$/hr of air coming from the outlet of the exchanger 2. This more volatile fluid is then put into liquid-vapor equilibrium at the medium pressure in the column 1 with the heavy fraction. At the head of the column 2 there is thus obtained the less volatile fluid, slightly impoverished in oxygen (95%) extracted from the column 1 at the rate of 210 $Nm^3$/hr at −162° and 5.8 ata.

This fluid is evacuated to the exchanger 22 in which it becomes heated in counter-flow with the entering air and is then evacuated from the exchanger at 27° C, at a pressure of 5.6 ata. The volatile fraction identical to the liquid rich in oxygen is also obtained from the tank of the mixing column 1 at −172° C., and this fraction after expansion in the valve 53 is introduced through the conduit 52 into the column 59. At an intermediate point of the mixing column 1 there is obtained the other volatile fraction at −167° C., comprising 80% of oxygen which, after expansion in the valve 55, is introduced into the column 59 through the conduit 54.

In accordance with FIG. 8, the column 59 under low pressure comprises 45 theoretical trays and the mixture column 1 has 40 theoretical trays.

It should be observed on the one hand that the flow-rate of air introduced into the mixing column 1 being of the order of 25% of the flow-rate of air, there is thus not introduced any sensible reduction in the oxygen extraction yield. On the other hand, as two additional light fractions are introduced into the column 59 (conduits 52 and 54), the reversibility of the distillation effected there is improved, and thus the efficiency of the said column 59 is increased.

It is clear that instead of extracting from the installation oxygen at 95% under a pressure of 5.6 ata, it is possible to extract oxygen at 99.5%, but then at 1 ata. In order that the oxygen may have a higher degree of purity, it is in fact necessary that the flow rate of air entering the column 25 should be increased in order that the bottom of the column 59 is not at the minimum reflux. The column 1 is then no longer in service and the air separation installation operates in the usual manner.

It is however also possible to produce oxygen at a purity of 99.5% with a cycle according to the invention, on condition however that a reduction of extraction yield in oxygen is accepted. In this case, it may be necessary to increase the number of connections between the columns 1 and 59 in order to obtain the necessary refluxes at all the points of these columns which are working at the limit of their possibilities.

Figure 9:
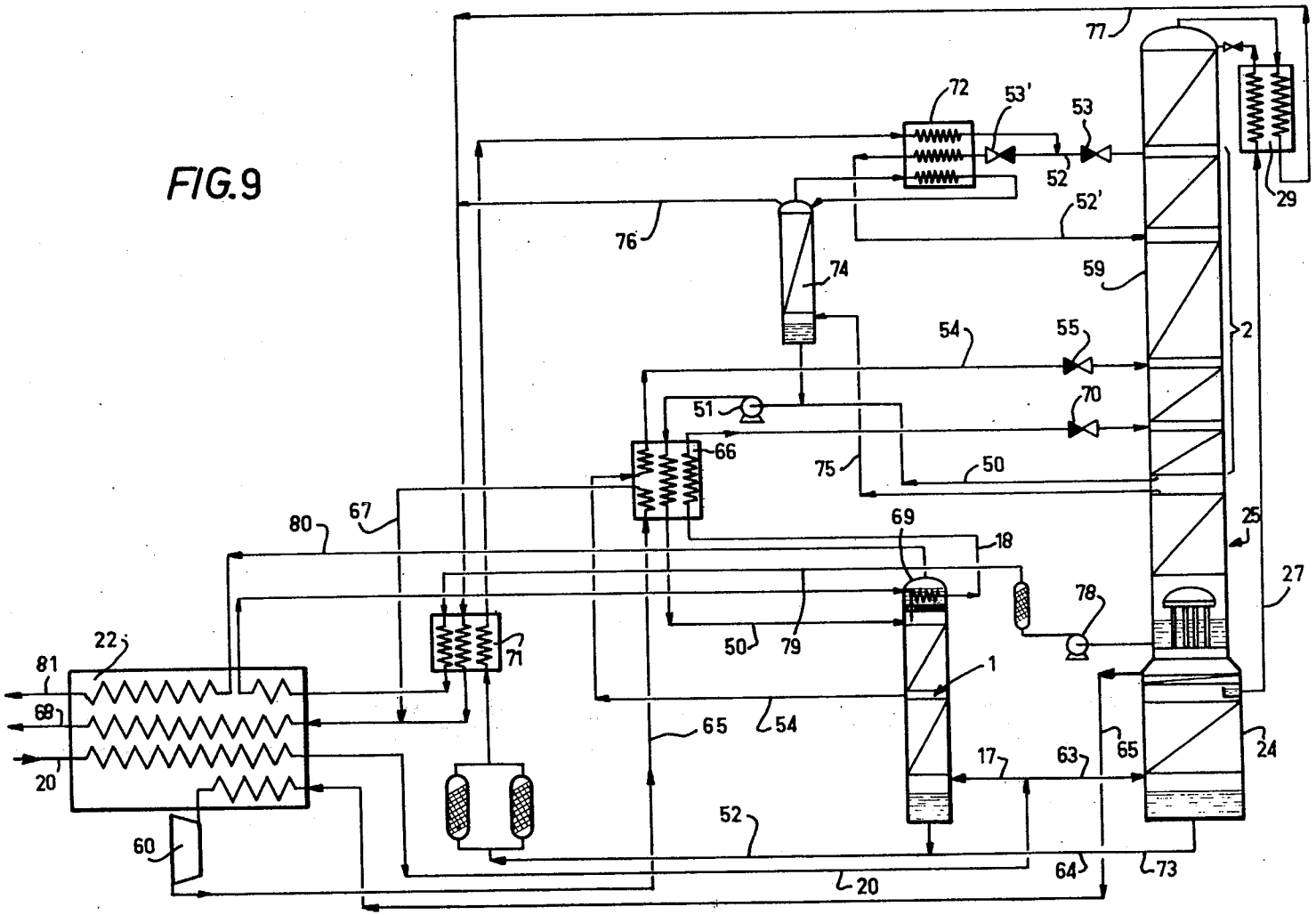
FIG. 9 represents a further installation for the separation of air, incorporating a thermal system according to the invention and again enabling oxygen to be produced under pressure.

The installation for fractionated distillation of air shown in FIG. 9, permits the production of pure oxygen at a pressure of 4.5 ata. The frigorific production of the installation is ensured by the expansion of pure nitrogen.

For this purpose, in operation, 1000 $Nm^3$/hr of air compressed to 6.3 ata, coming in through the conduit 20, are cooled from 30° C. to −171° C. in the exchanger 22. About 75.5% of the nominal flow-rate of air is introduced through the conduit 63 into the column 24 at medium pressure, comprising 20 trays. From the tank of the column 24 under medium pressure, there are extracted about 372 $Nm^3$/hr of a fraction enriched in oxygen (rich liquid) at −171.5° C., sent to the column under low pressure through the conduit 64.

From the upper portion of the column 24 there are extracted about 313 $Nm^3$/hr of a fraction impoverished in oxygen (poor liquid) through the conduit 27. After subcooling in the exchanger 29, expansion to a pressure of 1.3 ata, this fraction is introduced into the head of the column 59 at low pressure. About 70 $Nm^3/hr$ of 99.7% pure nitrogen at 175.5° C. are extracted from the column 24 and led through the conduit 65 to the exchanger 22, in which they are partly heated from −175.5° C. to −90° C. This flow is then expanded from 6.2 ata to 1.3 ata in the expansion turbine 63, which reduces its temperature to −141° C. These 70 $Nm^3/hr$ are then directed through the conduit 65 to the exchanger 66 in which they are partially cooled to −164° C. From this exchanger 66, the expanded nitrogen is directed through the conduit 67 to the exchanger 22, in which it is heated to ambient temperature and evacuated through the conduit 68.

In order to recover at least part of the energy consumed in separating the air into oxygen and nitrogen, it is chosen as shown in FIG. 9 to expand a more volatile fluid, constituted by the entering air, so as to re-compress a less volatile fluid constituted by a mixture enriched in argon.

for that purpose, the lower part of the fractionated separation section 2 being located at an intermediate zone of the column 59 at low pressure, there is obtained the less volatile fluid at low pressure, necessary for the thermal cycle according to the invention, by distillation at 1.6 ata of the liquid oxygen obtained in the tank of the column 59, in a lower section of this latter located below the fractionated separation section 2, and comprising 16 trays.

There are introduced into the upper portion of the separation zone 2, through the conduit 52, about 400 $Nm^3/hr$ of a first volatile fraction at −189° C., comprising 58.8% of nitrogen, 1.3% of argon and 39.9% of oxygen, and through the conduit 52', about 172 $Nm^3/hr$ of a second volatile fraction at −186° C. There are also introduced into a central part of the separation zone 2, through the conduit 54 about 260 $Nm^3/hr$ of a third volatile fraction at −176° C., comprising 25.7% of nitrogen, 4.9% of argon and 69.2% of oxygen.

At the head of the fractionated separation section 2 comprising 22 trays there is thus obtained a more volatile fluid having a composition close to that of air, which is distilled in the section of the column 59 located above the separation section 2. There is also obtained in the tank of the separation section 2, a heavy fraction extracted through the conduit 50 at the rate of 320 $Nm^3/hr$, comprising 0.2% of nitrogen, 7.9% of argon and 91.7% of oxygen.

After compression in the pump 51 and heating from −180° C. to −162.5° C., at least this heavy fraction is introduced, through the conduit 50 into the head of the mixing column at 6.1 ata. There is introduced into the tank of the mixing column 1, through the conduit 17, about 24.5% of the nominal flow-rate of air. There is thus obtained in the mixing column 1 a less volatile fluid comprising 5.8% of nitrogen, 10.7% of argon and 83.5% of oxygen, extracted from the mixing column 1 at 6.1 ata.

This less volatile fluid, re-compressed to 6.1 ata, is then condensed in a vaporizer 69 of liquid oxygen, subcooled to −176° C. by passage into the exchanger 66, expanded to the pressure of the column 59 in the valve 70 and then re-introduced into the column 59 between the heavy fraction extracted at 50 and the third light fraction introduced at 54.

In an intermediate zone of the mixing column 1 there is also obtained the above third volatile fraction which, after cooling from −167.4° C. to −176° C. in the exchanger 66, and expansion in the valve 55 is introduced into the column 59.

In the tank of the mixing column 1, there is also obtained a light fraction at 171.3° C., comprising 57.3% of nitrogen, 1.3% of argon, 41.2% of oxygen, extracted from the column 1 through the conduit 52 at the rate of 200 $Nm^3/hr$. This light fraction, to which is added the rich liquid extracted from the column 24 at medium pressure through the conduit 73, is then purified, sub-cooled in the exchanger 71 and then in the exchanger 72, divided into the above first light fraction which is expanded in the valve 53 and into the above second light fraction which is expanded in the valve 53' and heated in the exchanger 72.

The small quantity of poor liquid, sub-cooled in the exchanger 29 and introduced into the head of the column 59 through the conduit 27, permits an acceptable yield of extraction in oxygen to be obtained (93.5%). However, this quantity does not permit the separation of the oxygen and the argon in the upper part of the column 59; there is therefore utilized an argon-separation column 74.

For this purpose, a fraction rich in argon is extracted from the column 59 through the conduit 75 (representing about 10% of the nominal flow-rate of the air) in the gaseous form, below the heavy fraction evacuated by the conduit 50. This fraction is then separated in the column 74 into a tank fraction (100 $Nm^3$), combined with the heavy fraction of the conduit 50 and a head fraction (6 $Nm^3$) comprising 12.3% of nitrogen, 70.8% of argon and 16.8% of oxygen. The reflux of the column 74 is effected by condensation in the exchanger 72.

The head fraction extracted from the column 74 through the conduit 76 being poor in argon, this is rejected to the atmosphere through the conduit 68 by rejoining the expanded nitrogen in the turbine 60 after heating in the exchanger 71.

The nitrogen obtained with a purity of 97.7% at the top of the column 59 at low pressure is extracted from this latter at 1.3 ata and −192.5° C. at the rate of 727 $Nm^3/hr$, heated in the exchanger 29 and then evacuated to the exchanger 22 after successive combination with the fraction of the conduit 76 and that of the conduit 67.

As regards the oxygen obtained in the tank of the column 59 at low pressure, this is extracted from the latter at the rate of 197 $Nm^3/hr$ at −178.2° C. and at 1.6 ata, through the conduit 79. It is then re-compressed to 4.5 ata in the pump 78, heated in the exchanger 71 to −173° C. and then in a part of the exchanger 22, up to its boiling point. It then passes into the vaporizer 69, in which it is vaporized by exchange of heat with the less volatile fluid, under the medium pressure obtained at the head of the mixing column 1, and in course of condensation. After vaporization, the oxygen is evacuated from the vaporizer 69 through the conduit 80, heated from −166° C. to 27° C. in the exchanger 22, and then evacuated from this latter through the conduit 81.

In consequence, in the case of FIG. 9, a thermal cycle according to the invention permits the re-compression of a less volatile fluid and therefore the re-valorization of the calories of this latter. This heat is available at higher temperature and can then be employed to vaporize pure liquid oxygen under pressure. Finally, in this case, a thermal cycle according to the invention permits the recovery in a calorific form of at least part of the excess energy consumed in separating the air in the double column 25.

As compared with a conventional installation without a thermal cycle according to the invention of the type described above, producing pure gaseous oxygen under pressure, from the capital investment point of view an economy is made of the body of the turbo-compressor in which the said oxygen is usually compressed, while slightly increasing the additional investments necessary (in particular a mixing column, a small argon column and two pumps.)

From the energy consumption point of view, there is obtained according to the invention a reduction of the order of 10% in the specific energy for separation of oxygen. This arises especially from the fact that the column at low pressure works in a more reversible manner. It comprises additional feed points.

Figure 10:
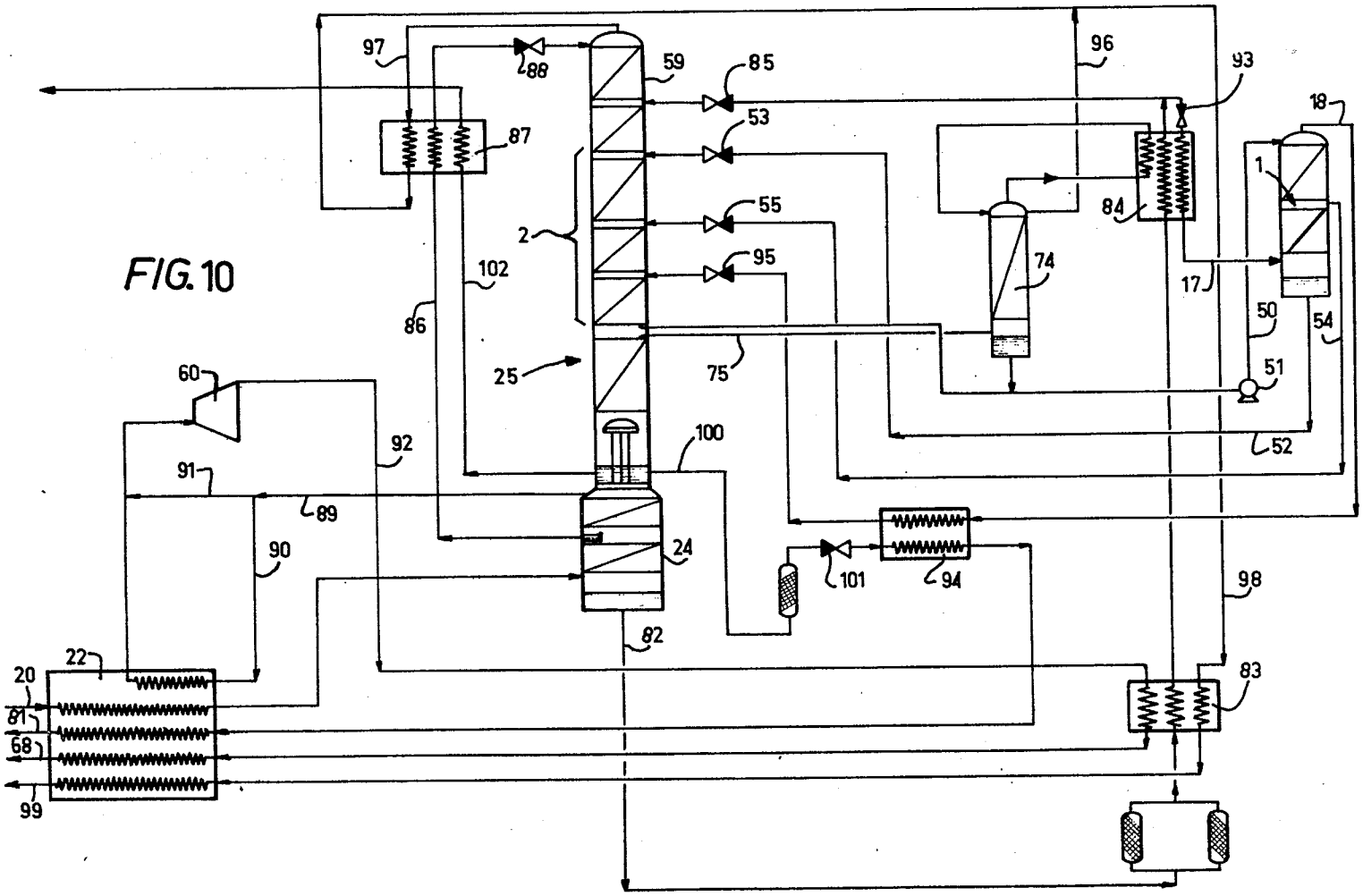
FIG. 10 shows still another installation for the separation of air, incorporating a thermal system according to the invention and enabling at least part of the oxygen to be produced in liquid form.

The air-separation installation shown in FIG. 10 permits the production of pure oxygen, partly in the liquid form. The frigorific production is also ensured by the expansion of pure nitrogen from the pressure of the lower column 24 to atmospheric pressure.

In operation, 1000 $Nm^3$/hr of air at a pressure of 6.25 ata are introduced and cooled in the exchanger 22. They are then introduced into the tank of the column 24 at medium pressure. From this column, there are extracted from the tank 480 $Nm^3$/hr of a fraction enriched in oxygen which, after purification, successive cooling in the exchanger 83 and the exchanger 84 and expansion to 1.3 ata in the valve 85 and is introduced in part (180 $Nm^3$/hr) into the upper part of the column 59 at low pressure.

There is also extracted in the liquid state from the column 24 a fraction of impure nitrogen (purity 89.5%) at the rate of 240 $Nm^3$/hr through the conduit 86, which, after cooling in the exchanger 87, and expansion in the valve 88 to 1.3 ata, is introduced into the head of the column 59. There are extracted from the head of the column 24 about 280 $Nm^3$/hr of ultra pure nitrogen through the conduit 89, of which part is heated, at least partially to −85° C. by passing into the exchanger 22 by means of the conduit 90, and in which another part circulating in the conduit 91, remains at the same temperature.

The said two parts are joined together, expanded into the turbine 60 from 6.25 ata to 1.35 ata, which reduces their temperature from −141° C. to −180° C. The expanded nitrogen is then directed through the conduit 92 to the exchanger 83 in which it is heated, and then to the exchanger 22, from which it is evacuated at ambient temperature by the conduit 68.

In order to recover at least part of the energy consumed in separating the air in the installation of FIG. 10, there is utilized a thermal system according to the invention, which acts, by means of the mixing column 1 and the separation zone 2, to compress a less volatile fluid (a fraction impoverished in nitrogen) by expansion of a more volatile fluid (a fraction enriched in nitrogen identical with the rich liquid exracted from the column 24, and which is vaporized).

For that purpose, in a lower section of the column 59 comprising 13 trays, there is distilled the oxygen obtained in the tank of the said column. There is thus obtained a more volatile fluid which then passes into the separation section 2 comprising 25 trays. Into the head of this section 2 there are introduced through the conduit 52 about 306 $Nm^3$/hr of a light fraction comprising 37.9% of nitrogen, 1.9% of argon, 60% of oxygen, and at an intermediate point of said section 2, through the conduit 54, about 210 $Nm^3$/hr of another light fraction comprising 22.5% of nitrogen, 4.5% of argon, 72.9% of oxygen. At the head of the section 2, there is thus obtained a more volatile fluid having a composition in the vicinity of that of the rich liquid extracted from the column 24, and in the tank of the said section, a heavy fraction comprising 0.1% of nitrogen, 7.4% of argon and 92.4% of oxygen extracted from the column 59 by the conduit 50 at the rate of 256 $Nm^3$/hr.

This heavy fraction, to which is added a fraction obtained from the column 74, is then re-compressed in the pump 51 to 1.8 ata and is introduced at the rate of 400 $Nm^3$/hr into the head of the mixing column 1. Into the tank of this same column there is introduced a more volatile fluid obtained from the rich liquid extracted through the conduit 82 from the tank of the column 24, of which a part (300 $Nm^3$/hr) is expanded to 1.95 ata in the valve 93, vaporized in the exchanger 84 and led to the column 1 through the conduit 17. The more volatile fluid thus obtained comprises 59.6% of nitrogen, 1.3% of argon and 39.0% of oxygen.

At the top of the column 1 there is thus obtained a less volatile fluid at −177° C. and 1.8 ata, comprising 8% of nitrogen, 9.8% of argon, 81.7% of oxygen. This is then evacuated through the conduit 18 at the rate of 184 $Nm^3$/hr, condensed in the exchanger 94, expanded in the valve 95 to the pressure of the column 59, and introduced into this latter between the heavy fraction extracted at 50 and the light fraction introduced at 54. There are also obtained the said fraction and the other light fraction referred to above which, after expansion respectively in the valves 53 and 55, are re-cycled into the separation section 2.

A gaseous fraction rich in argon, comprising 0.1% of nitrogen, 9.8% of argon and 90.1% of oxygen, is extracted from the column 59 at the rate of 148 $Nm^3$/hr and introduced into the auxiliary column 74 by the conduit 75. The reflux of this column is effected by condensation in the exchanger 84. From the head of the column 74 there is extracted a gaseous fraction (4.3 $Nm^3$/hr) rich in argon, which is evacuated with the residual gases of the installation through the conduit 96.

The substantially pure nitrogen extracted from the head of the column 59 is evacuated through the conduit 97 (523 $Nm^3$/hr), heated in the exchanger 87, again heated with the fraction in the conduit 96 in the exchanger 83, and then in the exchanger 20 by means of the conduit 98. These residual gases are then evacuated at ambient temperature from the exchanger 22 through the conduit 99.

With regard to the oxygen obtained in the tank of the column 59, a part is extracted from the installation in the liquid form, another part in the gaseous form. For that purpose, 176 $Nm^3$/hr of liquid oxygen at a purity of 99.5% are extracted through the conduit 100, expanded by the valve 101 from 1.7 ata to the vicinity of atmospheric pressure vaporized in the exchanger 94 by exchange of heat with the less volatile fluid during the course of condensation, circulating in the conduit 18 and coming from the column 1, and heated from −181° C. to the ambient temperature in the exchanger 20, from which they are extracted by the conduit 81. On the other hand, 16 $Nm^3$/hr of oxygen are extracted in the liquid form from the tank of the column 59 through the conduit 102, and cooled in the exchanger 87.

The extraction yields are 91.4% for oxygen, 43.9% for the argon and 35.8% for the nitrogen.

In consequence, in the case of FIG. 10, a thermal cycle according to the invention permits the recovery of at least part of the energy consumed in the installation, by compressing a suitable less volatile fluid, the heat of which thus revalorised is utilized to vaporize a part of the liquid oxygen obtained in the column at low pressure. The result is that the part of nitrogen which previously ensured the vaporization of the oxygen in the vaporizer-condenser of the double column 25 may then be expanded in the turbine 60.

It thus becomes possible to expand a flow of nitrogen equivalent to 28% of the flow of entering air. This excess of frigorific power then serves to obtain about 8% of the oxygen produced, in the liquid form through the conduit 102. Finally, in this case, the invention makes it possible to recover, in frigorific form, at least part of the energy consumed in the installation.

Figure 11:
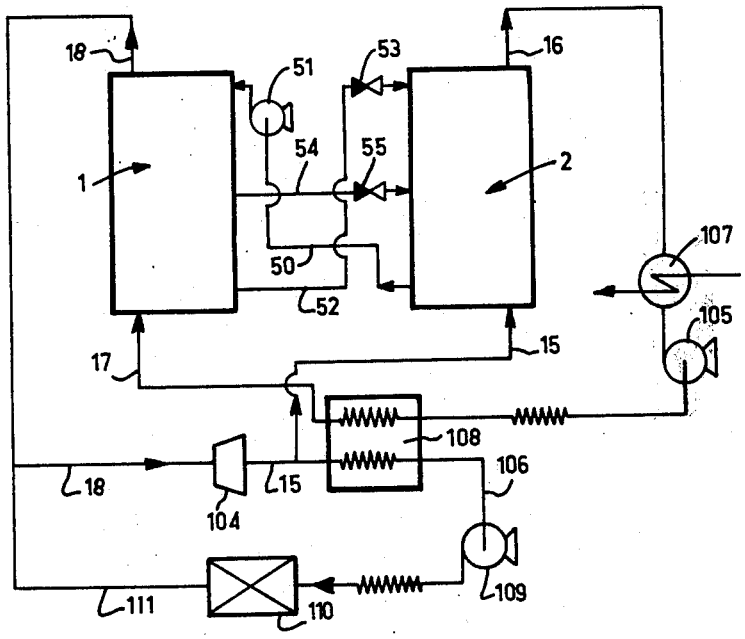
FIG. 11 represents an installation for generating mechanical energy, incorporating a thermal system according to the invention.

According to FIG. 11, a thermal cycle according to the invention is employed to produce energy in mechanical form.

It is known that work-generating thermal cycles working by expansion of steam necessitate very bulky condensation expansion turbines which are thus very expensive due to the fact of the low-pressure at the end of expansion. It has been attempted to improve these cycles by adding to them an auxiliary work-producing thermal cycle using ammonia expansion; in fact, it then becomes necessary to have available two turbines, which has a considerable influence on the cost of the energy produced.

A thermal cycle according to the invention, carried into effect in accordance with FIG. 11, makes it possible to overcome in a particularly harmonious manner, certain disadvantages of the known art.

As compared with FIG. 1, an installation producing mechanical energy further comprises an expansion means with external work or turbine 104, the upstream and downstream sides of which are respectively connected to the mixture zone 1 by the conduit 18 and to the separation zone 2 by the conduit 15. The installation further comprises a compression means in the liquid state or a pump 105, the upstream and downstream sides of which are respectively connected to the separation zone 2 by the conduit 16 and to the mixture zone 1 by the conduit 17.

In accordance with FIG. 11, in order to produce mechanical energy, a flow of steam is thus expanded in the turbine 104 from a high pressure to a low pressure. In order to obtain the said flow under high pressure, part of the steam is re-compressed from the low pressure to the high pressure in an auxiliary stage of the installation which utilizes a thermal cycle according to the invention, and the remaining portion in a main stage of the installation constituting the work-producing cycle of steam, properly so-called.

In the main stage, a first part of the steam at low pressure, taken off by the conduit 106, is condensed by passing into the exchanger 108. This condensed portion is then compressed in the liquid state at high pressure in the pump 109. This part under high pressure is then vaporized and superheated by passing into heating means 110. The steam thus produced is then returned to the turbine 104 by the conduit 111.

In the auxiliary stage, the remaining part of the steam at high pressure, taken-off by the conduit 15, is re-compressed at the high pressure by expansion of ammonia from the high pressure to the low pressure by means of a thermal cycle according to the invention, in which the less volatile fluid and the more volatile fluid are respectively constituted by water and ammonia.

For that purpose, the less volatile fluid (water) obtained from the conduit 18, expanded from the high to the low pressure in the turbine 104 is re-cycled in this stage by the conduit 15 into the separation zone 2. The more volatile fluid (ammonia) obtained from the conduit 16, is compressed in the liquid state from the low pressure to the high pressure in the pump 105 and is then re-cycled through the conduit 17 to the mixture zone 1.

In order to compress the re-cycled more volatile fluid in the liquid state, the latter is condensed before its introduction into the pump 105, at low pressure, in the condenser 107 with an external refrigerant (water for example), and the said fluid is vaporized after its evacuation from the pump 105 at high pressure, in the exchanger 108, by exchange of heat with the steam or less volatile fluid in course of condensation and circulating in the conduit 106.

Figure 12:
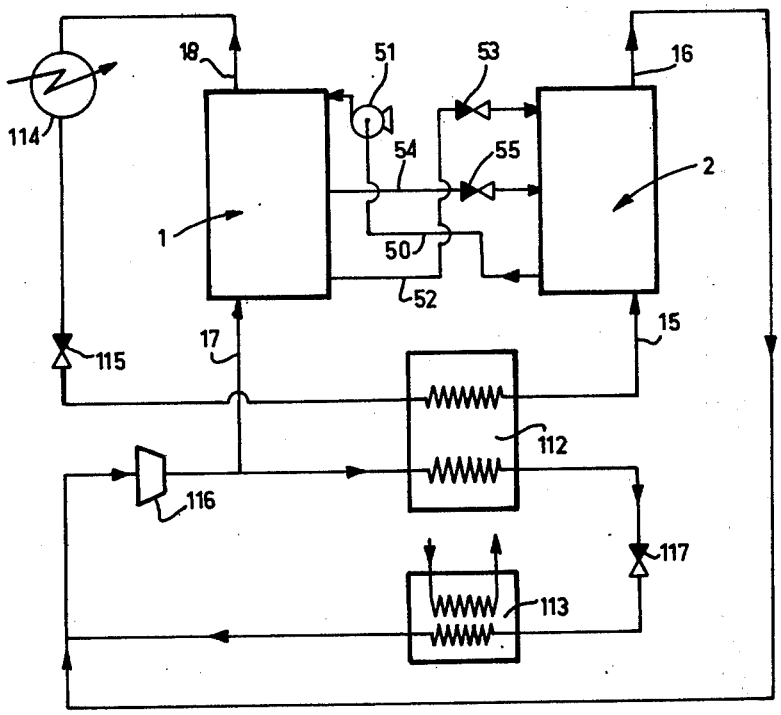
FIG. 12 represents a refrigeration installation which incorporates a thermal system according to the invention.

FIG. 12 represents a refrigeration installation comprising a thermal system according to the invention.

This installation, permitting the production of cold, comprises a first refrigeration state which makes it possible to deliver into a vaporizer 112, a frigorific energy at a hot temperature level, and a second refrigeration stage permitting the delivery of frigorific energy at a cold level of temperature. These two stages are associated thermally as in a Pictet cascade cycle, through the intermediary of the vaporizer-condenser 112. Finally, the refrigeration installation extracts cold from a condenser 114 at a hot temperature and returns it to the vaporizer 113 at a cold temperature.

The first stage is constituted by a thermal system according to the invention and further comprising an expansion valve 115 connected to the vaporized 112, the upstream side of the valve 115 being connected to the mixture zone 1 and the downstream side of the vaporizer 112 being connected to the separation zone 2.

In operation, in a first refrigeration stage, a less volatile fluid is compressed, constituting the refrigerant of the said stage, coming-in through the conduit 15, from a low pressure to a high pressure, by expansion of a more volatile fluid arriving through the conduit 17, from a high pressure to a low pressure.

The less volatile fluid circulating in the conduit 18 at high pressure is then condensed in a condenser 114 by means of an external refrigerant. The condensed less volatile fluid is then expanded at low pressure in the valve 115. It is vaporized in the vaporizer 112 at a hot temperature. The vaporized less volatile fluid is then re-compressed at high pressure through the conduit 15 by expansion of the more volatile fluid.

In the second refrigeration stage, in which the more volatile fluid constitutes the refrigerant, in conventional manner, the more volatile fluid is compressed to high pressure by the compressor 116. The said compressed fluid is condensed by exchange of heat in the vaporizer-condenser 112 with the less volatile fluid in course of condensation. The said condensed fluid at low pressure is expanded in the valve 117 and the expanded fluid is vaporized in the vaporizer 113 in order to deliver frigorific energy at low temperature. The vaporized fluid is re-compressed in the compressor 116.

In order to permit the re-compression of the less volatile fluid in the first stage of refrigeration, a part of the more volatile fluid at high pressure is taken-off at the outlet of the compressor 116 by the conduit 17, and the less volatile fluid obtained at low pressure is recycled through the conduit 16 to the intake of the compressor 116.

By way of example, the less volatile fluid may be a hydrocarbon with $C_4$, and the more volatile fluid may be a hydrocarbon with $C_3$.

What I claim is:

1. A method for compressing a less volatile fluid under a low pressure (15) with a more volatile fluid under a high pressure (17), which comprises:

a. in a fractional separation zone (2) under at least one low pressure, putting into counter-flow liquid vapor separation equilibrium at least the less volatile fluid (15) available in said fractional separation zone with at least one light fraction (52) at most as volatile as said more volatile fluid under a high pressure (17), thereby to obtain a more volatile fluid (16) under substantially said low pressure and at least one heavy fraction (50) at least as volatile as said less volatile fluid under a low pressure (15), said more volatile fluid under said low pressure being obtained substantially colder than said at least one heavy fraction, b. extracting (50) said heavy fraction from said fractional separation zone (2), compressing (51) said withdrawn heavy fraction from a low pressure to a high pressure, introducing said compressed heavy fraction into a fractional mixture zone (1), c. in said fractional mixture zone (1) under at least one high pressure, putting into counter-flow liquid-vapor mixture equilibrium at least the more volatile fluid (17) available in said fractional mixture zone with at least said heavy fraction (50), thereby to obtain a less volatile fluid (18) under substantially said high pressure and at least said light fraction (52), said less volatile fluid under said high pressure being obtained substantially warmer than said at least one light fraction, d. extracting (52) said light fraction from said fractional mixture zone, expanding (53) said withdrawn light fraction from a high pressure to a low pressure, and reintroducing said expanded light fraction into said fractional separation zone (2), each said high pressure being higher than each said low pressure, and each said less volatile fluid and heavy fraction being less volatile than each said more volatile fluid and light fraction.

2. A method as claimed in claim 1, in which said fractional separation zone comprises a single fractional separation column under low pressure, and said fractional mixture zone comprises a single fractional mixture column under high pressure.

3. A method as claimed in claim 2, in which said light fraction (52) is extracted from the tank of said fractional mixture column (1) and introduced, after expanding (53) from said high pressure to said low pressure, into the head of said separation column (2).

4. A method as claimed in claim 3, in which at least one further light fraction (54) is extracted from an intermediate zone of said mixture column (1) and is introduced, after expanding (55) from said high pressure to said low pressure, into an intermediate zone of said separation column (2).

5. A method as claimed in claim 1, in which said less volatile fluid (15) is introduced into the fractional separation zone (2) at least partially in the gaseous state, and said slight fraction (52) is introduced in said separation zone at least partially in the liquid state, and in which the more volatile fluid (17) is introduced into said fractional mixture zone (1) at least partially in the gaseous state, and said heavy fraction (50) is introduced at least partially in the liquid state in said mixture zone.

6. A method as claimed in claim 1, in which said heavy fraction (50) is heated, ater its compression (51) to a said high pressure and before its introduction into said mixture zone (1), by exchange (31) of heat with at least one light fraction (52) in the course of cooling before its expansion (53) into said fractional separation zone (2).

7. A method as claimed in claim 1, wherein there is effected a fractional distillation of a mixture of at least one heavy consitituent (B) and one light constituent (A) in a distillation zone (56) under at least one low pressure, and wherein said method is used to recover at least a part of the thermal energy consumed in distilling said mixture, by exchanging pressures between a less volatile fluid under a low pressure (15) comprising said heavy constituent and at least as volatile as this latter and a more volatile fluid under a high pressure (17) comprising said light constituent and at most as volatitle as this latter, said method comprising effecting said separation equilibrium inside said distillation zone (56) incorporating the separation zone (2) and effecing said mixture equilibrium outside said distillation zone in the mixture zone (1).

8. A method as claimed in claim 7, wherein a fractional distillation of air is effected into at least oxygen and nitrogen, in a distillation zone (25) comprising at least one distillation column (59) under a low pressure and another distillation column (24) under a medium pressure, higher than said low pressure, and wherein said separation equilibrium is effected inside the column under low pressure incorporating the separation zone in the form of a fractional separation section (2) extending over at least part of said column (59).

9. A method as claimed in claim 8, in which the lower portion of said fractional separation section (2) is located in the base of said column (59) under low pressure, at least part of said less volatile fluid undr a low pressure being obtained by vaporization of the liquid oxygen obtained in the base of said column.

10. A method as claimed in claim 8, in which the lower portion of said fractional spearation section (2) is located at an intermediate zone of said column (59) under low pressure, at least part of said less volatile fluid under a low pressure being obtained by distillation of the liquid oxygen obtained in the base of said column below said fractional separation section (2).

11. A method as claimed in claim 8, in which air (17) is introduced as said more volatile fluid under a high pressure in said fractional mixture zone (1).

12. A method as claimed in claim 8, in which at least part of said more volatile fluid (17) under a high pressure, introduced into said fractional mixture zone (1) is obtained by vaporization (84) of a fraction (82) enriched in oxygen produced in the base of said column (24) under medium pressure.

13. A method as claimed in claim 8, in which the upper portion of said fractional separation section (2) is located at an intermediate zone of the column (59) under low pressure, a more volatile fluid issuing under said low pressure from said fractional separation section being distilled in at least one upper section of said column, located above said fractional separation section (2).

14. A method as claimed in claim 8, in which said fractional mixture zone (1) comprsies a single mixing column (1) under a high pressure greater than the low pressure.

15. A method as claimed in claim 14, in which said high pressure is equal to said medium pressure.

16. A method as claimed in claim 14, in which said high pressure is comprised between said low pressure and said medium pressure.

17. A method as claimed in claim 8, in which the oxygen, separated from air by the fractional distillation, is extracted (18) as a product stream under medium pressure from the mixing zone, said product stream constituting said a less volatile fluid under said high pressure obtained in and withdrawn from the mixing zone.

18. A method as claimed in claim 8, in which the oxygen, separated from air by fractional distillation (25) is produced (81) under pressure the liquid oxygen obtained from the base of said column (59) under low pressure being compressed (78) and then at least partially vaporized (69) by exchange of heat with said less volatile fluid under said high pressure obtained in and withdrawn from the mixing zone of the thermal cycle.

19. A method as claimed in claim 8, in which oxygen is separated from air by fractional distillation (25), at least partly in the liquid from (102), at least part of the liquid oxygen obtained in the base of said column (59) under low pressure being vaporized by exchange (94) of heat with said a less volatile fluid (18) under said high pressure obtained in and withdrawn from the mixing zone.

20. A method as claimed in claim 1, producing mechanical energy by work-expansion (104) of a fluid, wherein at least part (15) of said a less volatile fluid under said high pressure (18) is work-expanded (104) to said low pressure and recycled to said fractional separation zone (2) as said less volatile fluid under a low pressure, and wherein at least a part (17) of said a more volatile fluid (16) under said low pressure is compressed (105) to said high pressure and recycled to said fractional mixture zone (1) as said more volatile fluid under a high pressure.

21. A method as claimed in claim 18, in which said part of said a more volatile fluid (16) under said low pressure is compressed (105) in the liquid state to said high pressure, and said compressed part is vaporized under said high pressure by exchange (108) of heat with another part of said a less volatile fluid (106) under said low pressure, in the course of condensation.

22. A method as claimed in claim 20, in which mechanical energy is generated by expansion (104) with external work of steam from a high pressure to a low pressure, at least a part (15) of said steam being recompressed as said less volatile fluid under a low pressure from said low pressure to said high pressure, by expansion of ammonia (17) as said more volatile fluid under a high pressure, from said high pressure to said low pressure, and said recompressed part of steam is recycled to the expansion (104).

23. A method as claimed in claim 22, in which said ammonia (16) under said low pressure, extracted from the separation zone is condensed by means of an external refrigerant (107), said condensed ammonia is pumped (105) from said low pressure to said high pressure, said pumped ammonia is vaporized (108) under said high pressure by exchange of heat with said steam (106) in the course of condensation under said low pressure, and said vaporized ammonia (17) under said high pressure is recycled to the mixture zone.

24. A method as claimed in claim 1, comprising at least one refrigeration state wherein a condensed refrigerant is exapnded (115) and vaporized to supply refrigeration, condensing (114) at least a part (18) of said a less volatile fluid under said high pressure, employed as said refrigerant, expanding (115) said condensed part to said low pressure, vaporizing (112) said expanded part under said low pressure for delivering said refrigeration, recycling said vaporized part (15) to said fractional separation zone (2) as said less volatile fluid under a low pressue, compressing (116) at least a part (16) of said a more volatile fluid under said low pressure, and recycling said compressed part (17) to said fractional mixture zone (1) as said more volatile fluid under a high pressure.

25. A method as claimed in claim 24, comprising at least one further state of refrigeration, wherein another condensed refrigerant is expanded (117) from said high pressure to said low pressure, said other expanded refrigerant being vaporized (113) in order to provide said refrigeration, said other refrigerant constituting said more volatile fluid under a high pressure, and wherein at least part (17) of said other refrigerant is introduced in the gaseous form under said high pressure into the fractional mixture zone (1), the said part is extracted (16) in the gaseous form under said low pressure, from said fractional separation zone, and at least the said part is recompressed (116) to a said high pressure and recycled to said fractional mixture zone.

26. A method as claimed in claim 24, in which said other refrigerant is condensed under said high pressure by exchange (112) of heat with the part of said refrigerant expanded under said low pressure, in the course of vaporization.

* * * * *